US005765556A

United States Patent [19]

Brunson

[11] Patent Number: 5,765,556

[45] **Date of Patent: *Jun. 16, 1998**

[54] DISPOSABLE AEROSOL MASK WITH FACE SHIELD

[75] Inventor: Kevin K. Brunson, Argyle, Tex.

[73] Assignee: Tecnol Medical Products, Inc., N. Richland, Tex.

[ * ] Notice: The term of this patent shall not extend beyond the expiration date of Pat. No. 5,322,061.

[21] Appl. No.: 491,137

[22] Filed: Jul. 17, 1995

Related U.S. Application Data

[63] Continuation of Ser. No. 168,090, Dec. 15, 1993, abandoned, which is a continuation-in-part of Ser. No. 991,154, Dec. 16, 1992, Pat. No. 5,322,061.

[51] Int. Cl.[6] ..... A62B 7/50

[52] U.S. Cl. ..... 128/206.19; 128/206.24; 128/206.25; 128/206.28; 128/207.11

[58] Field of Search ..... 128/206.21, 206.22, 128/206.23, 206.24, 206.27, 206.28, 207.11, 205.25, 205.27, 205.29, 206.12, 206.14, 206.18, 206.19, 206.25; 604/317, 384

[56] References Cited

U.S. PATENT DOCUMENTS

| | | | |
|---|---|---|---|
| D. 249,072 | 8/1978 | Revoir | D29/8 |
| D. 285,733 | 9/1986 | Cooper | D29/8 |
| D. 319,111 | 8/1991 | Sandel et al. | D29/9 |
| D. 327,141 | 6/1992 | Hubbard et al. | D29/9 |
| 1,987,922 | 1/1935 | Blatt | 128/139 |
| 2,012,505 | 8/1935 | Goldsmith . | |
| 2,116,241 | 5/1938 | Heumann | 128/139 |
| 2,227,667 | 1/1941 | Panettiere | 128/139 |
| 2,247,477 | 8/1941 | Lombard | 128/202 |
| 2,462,005 | 2/1949 | Schauweker | 128/146 |
| 2,494,406 | 1/1950 | Reitano | 128/146 |
| 2,556,589 | 6/1951 | Le Duc | 128/146 |
| 2,762,368 | 9/1956 | Bloomfield | 128/146 |

(List continued on next page.)

FOREIGN PATENT DOCUMENTS

| | | | |
|---|---|---|---|
| B50331 | of 1981 | Australia . | |
| 5033179 | 7/1981 | Australia . | |
| 1085259 | 6/1978 | Canada . | |
| 0355444 | 7/1989 | European Pat. Off. | A41D 13/00 |
| 0391726 | 10/1990 | European Pat. Off. | B19D 39/14 |
| 0515986 | 12/1992 | European Pat. Off. | A41D 13/00 |
| 0606686 | 7/1994 | European Pat. Off. | A41D 13/00 |
| 867791 | 7/1941 | France | 3/4 |
| 2471792 | 7/1979 | France . | |
| 655814 | 9/1938 | Germany . | |

(List continued on next page.)

OTHER PUBLICATIONS

U.S. Patent Application 08/278930, filed Jul. 20, 1994, and entitled, *Face Mask and Enhanced Seal and Method.*

U.S. Patent Application 08/499063, filed Jul. 6, 1995, and entitled, *Face Mask With Enhanced Fluid Barrier.*

The Mask Collection by Tecnol; Reprinted from AORN Journal, 1987.

(List continued on next page.)

*Primary Examiner*—Aaron J. Lewis
*Assistant Examiner*—Virendra Srivastarva
*Attorney, Agent, or Firm*—Dority & Manning

[57] ABSTRACT

A disposable mask that includes a filter body capable of filtering particles of a size appropriate for its purposes, while providing excellent breathability. An optically clear visor may be attached to opposite ends of the filter body to protect a wearer's eyes and face from liquid splash or spray. The filter body is formed from multiple layers of filtration material having the general configuration of a trapezoid. A darkened strip of material may be disposed on the exterior of the filter body adjacent to the visor to reduce glare and reflections by the visor. The mask is secured by straps to the head of a wearer. The straps are arranged to be approximately coextensive with a line extending from the edges which define the opening of the mask so that the edges are pulled into tight sealing engagement with the face of the wearer.

24 Claims, 3 Drawing Sheets

U.S. PATENT DOCUMENTS

| | | | |
|---|---|---|---|
| 3,049,121 | 8/1962 | Brumfield et al. | 128/146 |
| 3,170,461 | 2/1965 | Watts | 128/146 |
| 3,220,409 | 11/1965 | Liloia et al. | 128/146 |
| 3,288,138 | 11/1966 | Sachs | 128/139 |
| 3,316,904 | 5/1967 | Wall et al. | 128/146.6 |
| 3,620,214 | 11/1971 | Thackston | 128/146.2 |
| 3,664,335 | 5/1972 | Boucher et al. | 128/206.19 |
| 3,688,768 | 9/1972 | Reimschussel et al. | 128/146.2 |
| 3,779,244 | 12/1973 | Weeks, Jr. | 128/146.2 |
| 3,888,246 | 6/1975 | Lauer | 128/146.2 |
| 3,890,966 | 6/1975 | Aspelin et al. | 128/146.2 |
| 3,929,135 | 12/1975 | Thompson | 128/287 |
| 3,932,153 | 1/1976 | Byrns | 55/511 |
| 3,953,566 | 4/1976 | Gore | 264/288 |
| 3,971,369 | 7/1976 | Aspelin et al. | 128/146.2 |
| 3,971,373 | 7/1976 | Braum | 128/146.2 |
| 3,985,132 | 10/1976 | Boyce et al. | 128/146 |
| 4,187,390 | 2/1980 | Gore | 174/102 |
| 4,215,682 | 8/1980 | Kubick et al. | 128/205.29 |
| 4,319,567 | 3/1982 | Magidson | 128/206.19 |
| 4,323,063 | 4/1982 | Fisichella | 128/139 |
| 4,382,440 | 5/1983 | Kapp et al. | 128/205.28 |
| 4,384,577 | 5/1983 | Huber et al. | 128/206.19 |
| 4,417,575 | 11/1983 | Hilton et al. | 128/206.19 |
| 4,419,993 | 12/1983 | Petersen | 128/201.15 |
| 4,419,994 | 12/1983 | Hilston | 128/206.19 |
| 4,454,881 | 6/1984 | Huber et al. | 128/206.15 |
| 4,495,030 | 1/1985 | Giglia | 162/145 |
| 4,510,931 | 4/1985 | Henderson et al. | 128/202.28 |
| 4,536,440 | 8/1985 | Berg | 428/284 |
| 4,547,420 | 10/1985 | Krueger et al. | 428/229 |
| 4,551,378 | 11/1985 | Carey, Jr. | 428/198 |
| 4,600,002 | 7/1986 | Maryyanek et al. | 128/206.19 |
| 4,606,341 | 8/1986 | Hubbard et al. | 128/206.19 |
| 4,616,647 | 10/1986 | McCreadie | 128/206.19 |
| 4,635,628 | 1/1987 | Hubbard et al. | 128/201.17 |
| 4,641,645 | 2/1987 | Tayebi | 128/206.19 |
| 4,688,566 | 8/1987 | Boyce | 128/206.19 |
| 4,750,482 | 6/1988 | Sivercling | 604/317 |
| 4,797,956 | 1/1989 | Boyce | 2/431 |
| 4,802,473 | 2/1989 | Hubbard et al. | 128/206.19 |
| 4,807,619 | 2/1989 | Dyrud et al. | 128/206.16 |
| 4,827,924 | 5/1989 | Japuntich | 128/206.12 |
| 4,850,347 | 7/1989 | Skov | 128/206.16 |
| 4,856,509 | 8/1989 | Lemelson | 128/206.19 |
| 4,873,972 | 10/1989 | Magidson et al. | 128/206.12 |
| 4,883,052 | 11/1989 | Weiss et al. | 128/205.27 |
| 4,920,960 | 5/1990 | Hubbard et al. | 128/206.12 |
| 4,941,470 | 7/1990 | Hubbard et al. | 128/206.13 |
| 4,944,294 | 7/1990 | Borek, Jr. | 128/206.19 |
| 4,945,574 | 8/1990 | Dagher | 2/9 |
| 4,966,140 | 10/1990 | Herzberg | 128/206.19 |
| 4,969,457 | 11/1990 | Hubbard et al. | 128/206.122 |
| 5,003,631 | 4/1991 | Itoh | 2/9 |
| 5,020,533 | 6/1991 | Hubbard et al. | 128/206.23 |
| 5,025,506 | 6/1991 | Huang | 2/206 |
| 5,033,115 | 7/1991 | Bowling et al. | 2/51 |
| 5,035,240 | 7/1991 | Braun et al. | 128/205.27 |
| 5,094,236 | 3/1992 | Tayebi | 128/206.12 |
| 5,107,547 | 4/1992 | Scheu | 2/206 |
| 5,150,703 | 9/1992 | Hubbard et al. | 128/206.12 |
| 5,322,061 | 6/1994 | Brunson | 128/206.13 |
| 5,368,021 | 11/1994 | Beard et al. | 128/205.14 |
| 5,406,943 | 4/1995 | Hubbard et al. | 128/206.23 |
| 5,419,318 | 5/1995 | Tayebi | 128/205.27 |

FOREIGN PATENT DOCUMENTS

| | | | |
|---|---|---|---|
| 688227 | 1/1940 | Germany . | |
| 7706660 | 1/1977 | Germany . | |
| 2717968 | 7/1977 | Germany | 128/335 |
| 4789 | 7/1912 | United Kingdom . | |
| 5104 | 9/1913 | United Kingdom . | |
| 967455 | 4/1960 | United Kingdom . | |
| 892262 | 6/1962 | United Kingdom | 128/206.19 |
| 1049604 | 9/1964 | United Kingdom . | |
| 1433504 | 6/1973 | United Kingdom . | |
| 1473924 | 4/1974 | United Kingdom . | |
| 1588442 | 8/1977 | United Kingdom . | |
| 2028664 | 3/1980 | United Kingdom . | |
| 2059782 | 3/1980 | United Kingdom . | |
| 2072516 | 3/1980 | United Kingdom | 128/206.21 |
| 2103491 | 6/1983 | United Kingdom | A62B 7/10 |
| 7900118 | 1/1979 | WIPO . | |
| 8103266 | 3/1981 | WIPO | A41D 13/00 |
| 8601734 | 3/1986 | WIPO | A62B 18/08 |
| 8900874 | 2/1989 | WIPO | A62B 12/02 |
| 8910106 | 11/1989 | WIPO | A61F 9/04 |
| 9108829 | 6/1991 | WIPO | B01D 71/36 |

OTHER PUBLICATIONS

R1050 AO Safety Products Brochure. Dust Demon Foldable. Reusable/Diposable Respirator. dated 1989.

Glendale Brochure. DUSTBUSTER Comfort Plus Full Dist and Mist Protection. 7/92/10M.

Tecnol FLUIDSHIELD Brochure. "The First Mask Specifically Designed to Resist Fluid Penetration".

Tecnol FLUIDSHIELD Brochure. "The Only Masks with Loncet Breathable Film . . . Your Extra Layer of Protection from Body Fluids". dated 1992.

W.T. Davis. "Filtration Efficiency of Surgical Face Masks: The Need for More Meaningful Standards." American Journal of Infection Control., pp. 16–18. dated Feb. 1991.

"DELTA Disposable Respirators" Racal Health & Safety. 1993. (4 pages).

Annotated Figure 2.

European Search Report (Notification. 1 page dated May 5. 1995; Communication dated Apr. 27. 1995. 4 pages total).

EPO correspondence to Uexkull & Stolberg. re: European search report. dated Apr. 27. 1995. Application No. EP 94 25 0231. 5 pages.

AIPO correspondence to F. B. Rice & Co. dated Jul. 12. 1995 citing Austrialian Patent No. AU 50331/79. 4 pages.

Tecnol. The Aorn Journal. *The Mask Collection,* 1987. 4 pages.

Glendale Protective Technologies. Inc.. *Glendale Dustbuster,* Jul. 1992. 1 page.

AO Safety Products. R1050 *Dust Demon Foldable, Reusable/Disposable Respirator,* undated. 2–sided/2 pages.

Tecnol. *FluidShield Surgical Masks featrung SplashGuard Visors,* Nov. 1992. 1 page/2–sided.

Wayne T. Davis. Ph.D.. *American Journal of Infection Control, Filtration effciency of surgical face masks: The need for more meaningful standards,* undated. 3 pages.

Tecnol. *FluidShield,* undated. 6 pages.

Racal Health & Safety. Inc.. *Delta Disposable Respirators,* 1993. 4 pages.

Annotation Fig. 2. undated. 1 page.

United States Patent Application No. 08/374.321 filed Jan. 18. 1995 entitled *Face Mask with Enhanced Facial Seal,* pending.

United States Patent Application No. 08/374.300 filed Dec. 12. 1995 entitled *Face Mask with Enhanced Seal and Method,* pending.

FIG. 1
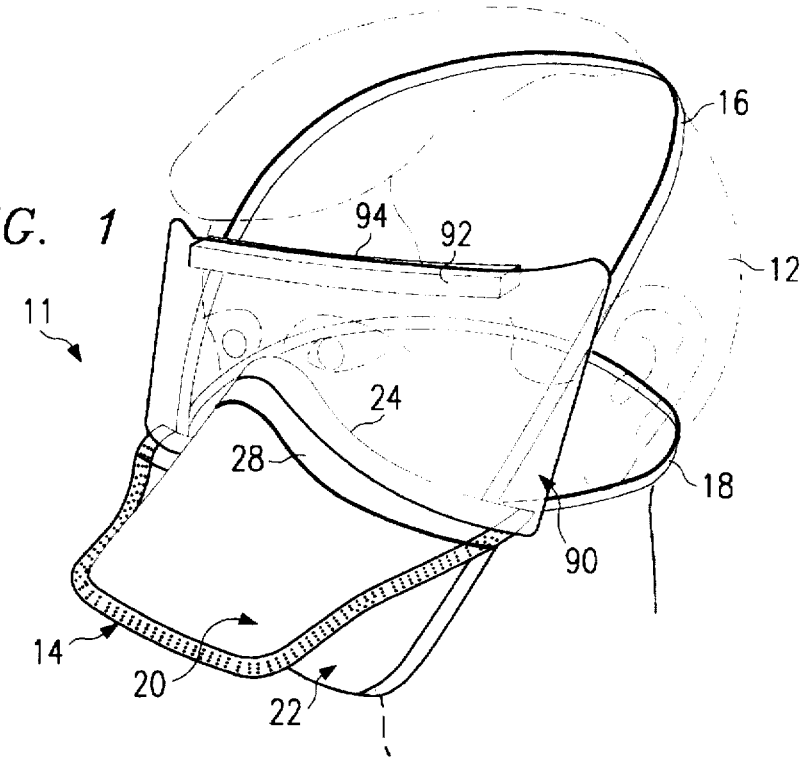
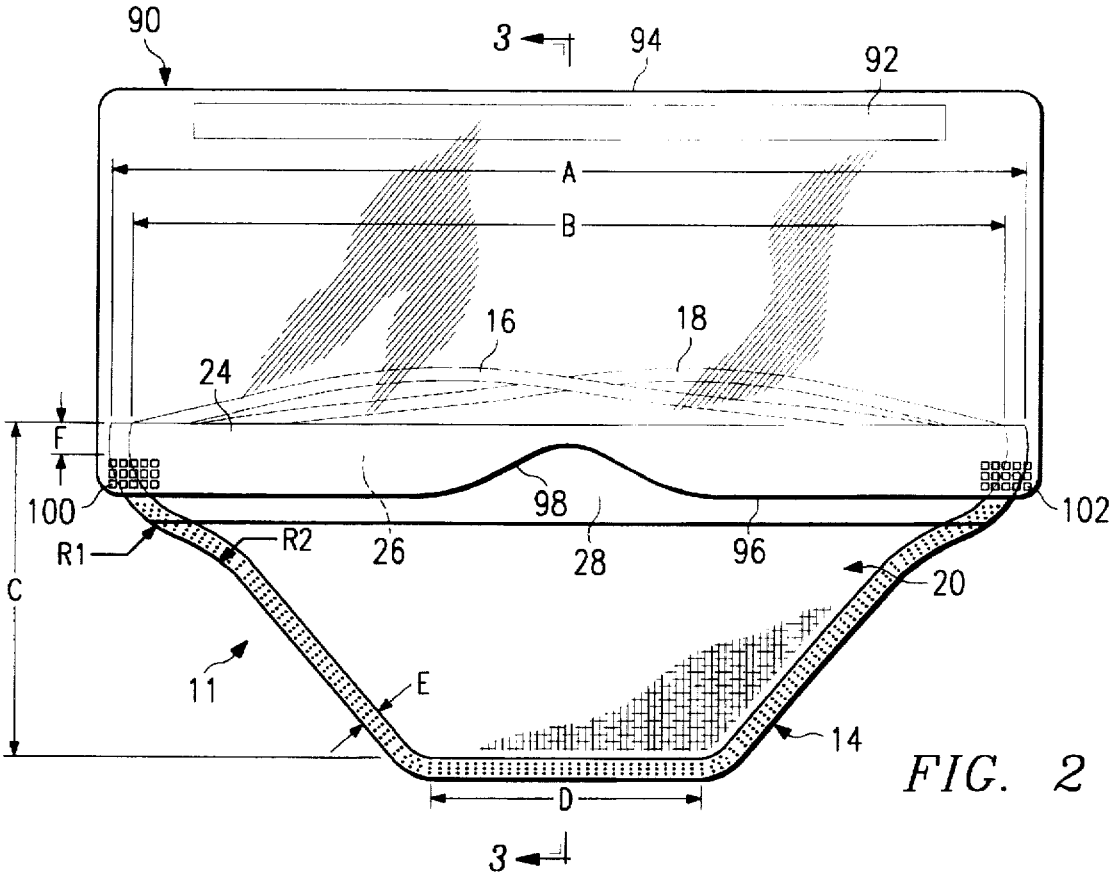
FIG. 2

DISPOSABLE AEROSOL MASK WITH FACE SHIELD

RELATED APPLICATIONS

This application is a Continuation application in lieu of patent application Ser. No. 08/168,090 filed Dec. 15, 1993, entitled Disposable Aerosol Mask with Face Shield, now abandoned, which is a Continuation-in-Part application related to patent application Ser. No. 07/991,154 filed Dec. 16, 1992 by Kevin K. Brunson, entitled Disposable Aerosol Mask, same assignee, now U.S. Pat. No. 5,322,061 dated Jun. 21, 1994; reexamination is currently pending for U.S. Pat. No. 5,322,061.

TECHNICAL FIELD OF THE INVENTION

This invention relates generally to a face mask capable of preventing passage of airborne aerosol particles. More particularly, and not by way of limitation, this invention relates to a disposable face mask having a relatively low pressure drop to permit easy breathing, while preventing aerosol particles from passing therethrough and therearound. A visor or shield may be attached to the mask to prevent liquids from contacting the eyes of a wearer.

BACKGROUND OF THE INVENTION

Disposable masks have been manufactured for many years. In the medical field, most of these masks have been for use in preventing contamination of a patient by the breath of health care personnel. In recent years with increased concern for infection of health care personnel with airborne pathogens, such as the hepatitis B virus, it has become necessary to prevent not only the contamination of patients due to exhalation from health care personnel, but also to prevent infection of health care personnel due to inhalation of airborne infection particles. It has become even more important in view of the advent of human immunodeficiency virus (HIV) and the recent increase in infectious tuberculosis associated with many HIV patients.

In addition, it has been found that aerosols having airborne liquid and solid particles are generated not only by the exhalation of infected patients, but also by certain procedural manipulations and processes that impart energy to any microbial suspension. Surgical procedures involving use of drills and saws are particularly prolific producers of the aerosols which may contain tuberculosis, HIV or other pathogens from an infected patient. Concern with tuberculosis has been increasing since new strains of the disease show strong resistances to multiple types of drug treatment.

In addition, it has been shown that many of the viral hemorrhagic fevers such as yellow fever, Rift Valley fever and perhaps Rocky Mountain spotted fever, rabies and smallpox can be transmitted through aerosols. A considerable number of studies have been made which are now beginning to identify the transmission of such viruses through "non-accident" situations. Accordingly, it is now believed that many of those "non-accident" situations result from aerosol contamination.

Of the current medical masks on the market, it appears that many are not effective against aerosols. One of the presently available molded-type surgical masks has almost no resistance to particles smaller than two (2) microns and has a low efficiency in blocking particles as large as nine (9) microns. Some masks apparently demonstrate somewhat better qualities, but none appear to be fully satisfactory in preventing the passage of aerosols through the mask or around the periphery of the mask.

One type of mask is illustrated in U.S. Pat. No. 2,012,505 entitled Mask, issued on Aug. 27, 1935 to S. J. Goldsmith. Another type of disposable face mask is illustrated in U.S. Pat. No. 4,319,567 entitled Disposable Face Mask, issued on Mar. 16, 1982 to M. Magidson. This mask is molded and has been especially configured in an effort to avoid leakage of fluid flow past the edges of the mask. Obviously, leakage cannot be tolerated when attempting to control aerosols. U.S. Pat. No. 4,606,341 entitled Noncollapsible Surgical Face Mask, issued Aug. 19, 1986 to Vance M. Hubbard and Welton K. Brunson shows a conventional rectangular face mask having a trapezoidal pleat. Rectangularly shaped masks, including the mask shown in Patent '341, have less than an optimal fit to prevent the passage of aerosols between the periphery of the masks and a wearer's face. An additional folded type mask is illustrated in U.S. Pat. No. 4,688,566 entitled Filter Mask, issued on Aug. 25, 1987 to Elvin L. Boyce.

Recent developments in surgical face mask have resulted in improved resistance to liquid penetration from the exterior of such masks. Visors or face shields are often attached to such surgical masks to protect the eyes of a wearer. U.S. Pat. No. 4,920,960 entitled Body Fluids Barrier Mask, issued on May 1, 1990 to Hubbard, et al., is exemplary of improvements in such masks. U.S. Pat. No. 5,020,533 entitled Face Mask with Liquid and Glare Resistant Visor, issued on Jun. 4, 1991 to Hubbard, et al., is an example of incorporating a visor to protect the face of a wearer from liquids during medical procedures.

SUMMARY OF THE INVENTION

In accordance with the present invention, an improved aerosol mask is provided to substantially reduce or eliminate the shortcomings previously associated with aerosol-type face masks. For some applications, a face shield may be attached to the improved aerosol mask in accordance with the present invention. For other applications, the improved aerosol mask may include one or more layers of expanded polytetrafluoroethylene.

An aerosol mask and a face shield incorporating the present invention provide an improved seal with the face of a wearer, higher filtration capability with respect to aerosols, a sufficiently low pressure drop through the mask for comfortable breathing, and improved protection from liquid splashes or liquid sprays.

In one aspect, this invention provides a disposable mask comprising a filter body for covering the nose and mouth of a wearer. The body has top and bottom edges with the top edge arranged to extend across the bridge of the nose of the wearer and the bottom edge arranged to extend under the wearer's chin. A first securing member may be attached to the body adjacent each end of the top edge and disposed generally about the back of the head of the wearer in an approximate linear continuation of the top edge urging the top edge into tight engagement with the wearer's face to prevent fluid flow between the top edge and the wearer's face. A second securing member may be attached to the body adjacent to each end of the bottom edge and disposed generally over the top of the wearer's head in an approximate linear continuation of the bottom edge urging the bottom edge into tight engagement with the wearer to prevent fluid flow between the bottom edge and the wearer's face. A clear visor or face shield may be attached to the filter body adjacent to each end of the top edge and positioned generally over the eyes and portions of the wearer's face which are not covered by the filter body. The resulting mask and face shield provide an enhanced seal around the periphery of the mask to prevent bypass of aerosols between the edges of the mask and the wearer's face and protection from liquid spray or splash contacting the wearer's eyes.

In another aspect, the present invention contemplates the method of making a disposable aerosol mask that includes a plurality of layers of selected materials, comprising the steps of placing first and second inner mask layers with generally trapezoidal shapes in juxtaposition to form the inside surface of the mask, placing one or more intermediate layers of material having a generally trapezoidal shape in juxtaposition with the first inner mask layer and the second inner mask layer respectively, placing a first outer mask layer of generally trapezoidal shape in juxtaposition with the first inner mask layer and its respective intermediate layer or layers to form a top outside surface of the mask, placing a second outer mask layer of generally trapezoidal shape in juxtaposition with the second inner mask layer and its respective intermediate layer or layers to form a bottom outside surface of the mask, connecting the first inner mask layer, associated intermediate layers, first outer mask layer to form a top edge along an unconnected side of the generally trapezoidal shape, connecting the second inner mask layer, associated intermediate layers and second outer mask layer to form a bottom edge along the unconnected side of the generally trapezoidal shape, securing an elongated malleable member along the top edge, placing a darkened strip of material along a portion of the first outer mask layer, connecting the darkened strip of material to the top edge, and attaching securing means for holding the mask on a wearer between the layers adjacent to junctions of the top and bottom edges. A clear visor or face shield may then be bonded to the mask at opposite ends of the top edge.

The present invention has significant technical advantages in that a face mask and visor are provided for forming a barrier with the face of a wearer to prevent passage of aerosols between the periphery of the mask and the wearer's face and to block liquid spray and splashes from contacting portions of the wearer's face which are not covered by the mask. The general trapezoidal shape of the face mask cooperates with inner and outer radii on opposite sides of the mask to provide a relatively flat sealing surface with the face of a wearer. The inner radii portions on opposite sides of the mask cooperate to position the visor relative to the mask and the wearer's eyes. The mask also provides substantially increased flow area for the passage of air through the mask during normal breathing by the wearer while at the same time allowing the use of filtration media having higher resistance to the passage of aerosols through the mask. The present invention allows optimizing the filtration capability for resistance to the passage of aerosols while minimizing the restriction to normal breathing caused by wearing the mask. The present invention also allows for a substantially improved fit between the periphery of the mask and the contours of a wearer's face and positioning an optically clear visor attached to the mask with respect to the eyes and face of the wearer.

An additional technical advantage of the present invention includes attaching a visor to the aerosol mask to eliminate the need for separate eye protection. Curved radii on each side of the mask provide a portion of the means for attaching the visor to the aerosol mask and assist the visor to conform with the wearer's face.

A further technical advantage of the present invention includes a darkened strip of material placed on the top edge of the mask to substantially reduce reflections and glare. The darkened strip of material is particularly beneficial if an optically clear wraparound visor has been attached to the upper portion of the mask to protect the wearer's eyes from liquid splash or spray.

Another technical advantage of the present invention includes the use a filter media formed from expanded polytetrafluoroethylene (PTFE) membrane with one or more layers of bicomponent polyethylene or polypropylene disposed on opposite sides of the filter media.

BRIEF DESCRIPTION OF THE DRAWINGS

For a more complete understanding of the present invention and the advantages thereof, reference is now made to the following description taken in conjunction with the accompanying drawings, in which:

FIG. 1 is a perspective view of a mask or respirator with an optically clear visor attached in accordance with the present invention and illustrated on the head of a wearer;

FIG. 2 is the plan view of the mask and visor of FIG. 1;

DETAILED DESCRIPTION OF THE INVENTION

Figure 3A:
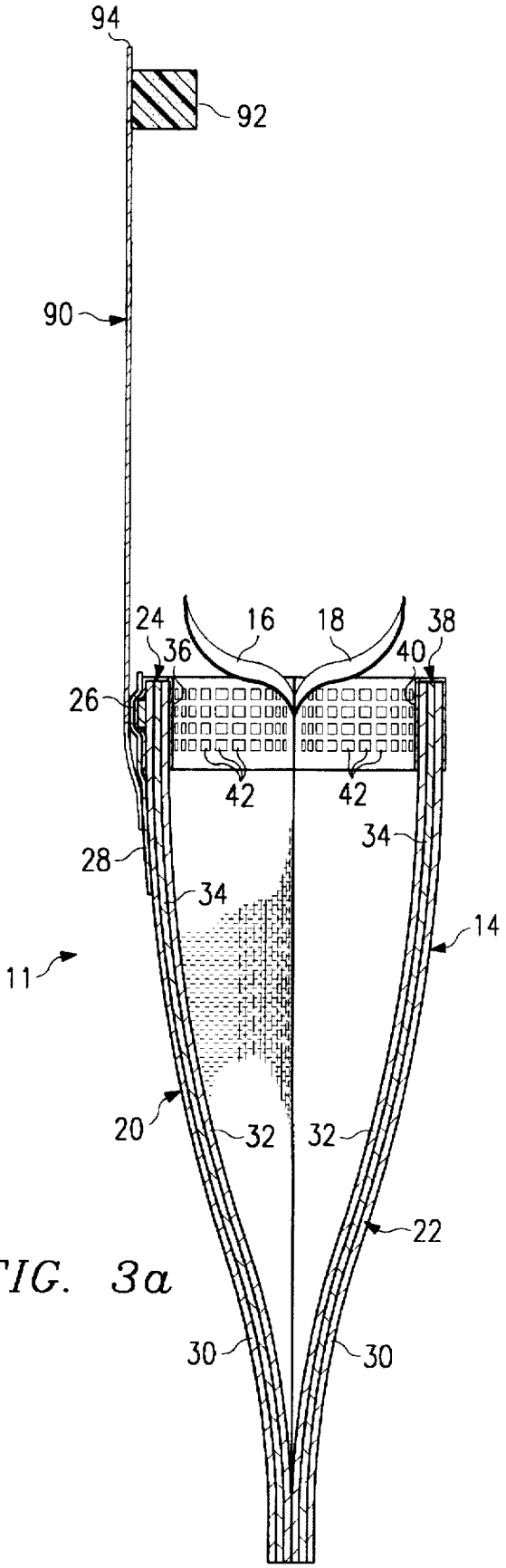
FIG. 3*a* is a drawing in section and in elevation with portions broken away of the mask and visor of FIG. 1 taken generally along lines 3*a*—3*a* of FIG. 2.

The preferred embodiments of the present invention and its advantages are best understood by referring to FIGS. 1–4 of the drawings, like numerals being used for like and corresponding parts of the various drawings.

Mask 11 with attached visor 90 is illustrated in FIG. 1 as being positioned on the face of wearer 12 shown in ghost lines. Mask 11 includes filter body 14 which is secured to wearer 12 by means of resilient and elastic straps or securing members 16 and 18. Filter body 14 comprises an upper portion 20 and a lower portion 22 which have a generally trapezoidal configuration. Upper and lower portions 20 and 22 preferably have matching exterior dimensions and shape. Upper and lower portions 20 and 22 may be bonded together by heat and/or ultrasonic sealing along three sides of filter body 14. Bonding in this manner adds important structural integrity to mask 11.

The fourth side of filter body 14 is open and includes a top edge 24 with an elongated malleable member 26 (see FIGS. 2 and 3*a*). Malleable member 26 is provided so that top edge 24 of mask 11 can be configured to closely fit the contours of the nose and cheeks of wearer 12. Malleable member 26 is preferably constructed from an aluminum strip with a rectangular cross-section, but may also be a moldable or malleable steel or plastic member.

A darkened strip of material 28 may be applied to the exterior of upper portion 20 adjacent to top edge 24. Darkened strip 28 is provided to reduce glare and reflections. The use of darkened strip 28 is particularly beneficial when visor 90 is attached to filter body 14. Darkened strip 28 may comprise any suitable material such as treated color stock. For some applications, darkened strip 28 is preferably black in color and the exterior of upper portion 20 is preferably orange in color.

Top edge 24 of upper portion 20 and bottom edge 38 of lower portion 22 cooperate with each other to define the periphery of mask 11 which contacts the face of wearer 12. The present invention allows optimizing the barrier formed between the periphery of mask 11 and the face of wearer 12 and the filtration capability of mask 11 to resist the passage of particulate matter and aerosols through filtration media 34 while minimizing resistance to normal breathing of wearer 12 resulting from the use of mask 11. The present invention also allows including multiple layers of filter media within filter body 14 including layer 44 of liquid impervious material.

As shown in FIGS. 1 and 3*a*, mask 11 has the general shape of a cup or cone when placed on the face of wearer 12. The present invention allows mask 11 to provide "off-the-face" benefits of a molded-cone style mask while still being easy to package, store and ship with visor 90 attached to filter body 14. "Off-the-face" style masks provide a larger breathing chamber as compared to soft, pleated masks which contact a substantial portion of the wearer's face. Therefore, "off-the-face" masks permit cooler and easier breathing. The present invention allows optimizing the volume of air contained within filter body 14. If the volume is too large, excessive amounts of exhaled air may be retained within filter body 14 at normal breathing rates. By properly selecting the size of filter body 14, excessive heating of the air within filter body 14 is minimized and dizziness from prolonged periods of rebreathing exhaled air is also minimized.

Face shield or visor 90 preferably comprises a clear, plastic film such as polyester or polyethylene. Visor 90 is generally dimensioned to fit across the portions of the face of wearer 12 which are not covered by mask 11. Visor 90 is specifically positioned on filter body 14 to protect the eyes of wearer 12 from liquid spray and liquid splashes. The plastic material comprising visor 90 may have a thickness of approximately 0.005 inches with enough stiffness to prevent collapse and yet having sufficient flexibility to bend and conform generally with the face of wearer 12. As will be explained later in more detail, visor 90 is preferably bonded to filter body 14 at opposite ends of top edge 24.

The approximate optimum dimensions for mask 11 as shown in FIG. 2 include 10¼" for the major length, dimension A, of the trapezoidal shape of filter body 14. The length of the opening in filter body 14 defined in part by top edge 24 and bottom edge 38, dimension B, is 9 ¼" due to approximately ½" of seal at each junction between upper portion 20 and lower portion 22. The minor length of the parallel portion of trapezoid shaped filter body 14, dimension D, is 3⁵⁄₁₆". The opening of filter body 14 defined in part by dimensions A and B is generally parallel with minor length, dimension D. The dimensions A and B may be varied by ±¾". The width of the trapezoid shape of filter body 14, dimension C, is 3 ½". Dimensions C and D may be varied by ±¼". The bonded border defining the three closed sides of mask 11, dimension E, is preferably ¼" in width. The portions of top edge 24 and bottom edge 38 which contact the wearer's face, dimension F, are preferably ½" in width.

Visor 90 preferably has a generally rectangular configuration with rounded corners. The length of visor 90 is preferably selected to be slightly larger than dimension A of filter body 14. The width of visor 90 is selected to be approximately equal to dimension C, the width of filter body 14. Foam strip 92 is preferably secured to the interior surface of visor 90 near upper edge 94. Foam strip 92 is preferably long enough to span the forehead of wearer 12. The width of foam strip 92 is selected to prevent visor 90 from directly contacting the forehead of wearer 12. Foam strip 92 may also be positioned to prevent sweat from dripping into the eyes of wearer 12. Lower edge 96 of visor 90 preferably includes notch 98 which allows visor 90 to conform with the nose and face of wearer 12 without causing creases or wrinkles in visor 90.

The above dimensions may be modified to accommodate wearers having smaller or larger facial features. However, the ratio between the width of the trapezoid shape which defines mask 11, dimension C, as compared to the minor length of the trapezoid shape, dimension D, should preferably remain at approximately 1 to 1. The preferred ratio between the major length of filter body 14, dimension A, and the minor length, dimension D, is approximately 3 to 1. For many applications, the length of visor 90 should remain slightly larger than dimension D and the width of visor 90 approximately equal to dimension C.

An important feature of the present invention is forming radius R1 of approximately 1⅛" and radius R2 of approximately 3" in the non-parallel or angled sides of filter body 14. Radii R1 and R2 cooperate with each other to prevent collapse of filter body 14 during normal breathing by wearer 12. These radii, R1 and R2, help mask 11 retain the desired, off-the-face shape during normal breathing. If the sealed border on the three closed sides of filter body 14 is less than ¼", mask 11 may tend to collapse during normal breathing. Therefore, an important feature of the present invention includes combining radii R1 and R2 with a sealed border of approximately ¼" in width to provide the desired cone or cup shaped mask covering the nose and mouth of wearer 12 and to maintain a fluid tight barrier with wearer 12's face without collapsing during normal breathing.

Radius R2 curves outward from opposite sides of mask 11 and is tangent to radius R1 that curves inward towards the attachment points for headbands 16 and 18 and visor 90. This arrangement is a critical feature of the present invention and serves several important functions. Radii R1 and R2 cooperate with each other to improve the facial seal performance between the periphery of mask 11 and the face of wearer 12. Radii R1 and R2 allow mask 11 to open with relatively flat surfaces near each end of top edge 24 and bottom edge 38 adjacent to the attachment point for headbands 16 and 18. These flat surfaces adjacent to the attachment points for the headbands 16 and 18 and visor 90 gradually taper away from the opening in filter body 14. The general trapezoidal shape of filter body 14 in cooperation with radii R1 and R2 and the other preferred dimensions and ratios cooperate to minimize collapse of filter body 14 during normal use of mask 11.

Radii R1 and R2 cooperate with top edge portion 24 and bottom edge portion 38 to allow mask 11 to fit securely with and to form a tight facial seal on a greater number of different face sizes. Mask 11 is particularly useful with smaller faces which contact the tapered surfaces adjacent to the attachment points for headbands 16 and 18 on the interior of mask 11 as shown in FIG. 10. Other types of surgical masks frequently have contact between the periphery of the mask and the skin of the wearer's face at an acute angle with only the narrow, bonded edge of the mask providing a sealing surface.

Radii R1 and R2 assist in maintaining the integrity of mask 11 by providing strength along the three-bonded sides of filter body 14 when mask 11 is fully opened against the face of a wearer. These previously described design features allow for the use of lighter weight or lighter basis material which adds breathability and comfort to mask 11. Without radii R1 and R2 these same lightweight materials would be prone to collapse during inhalation. The ¼" bonded seal around the three closed sides of filter body 14 contributes to maintaining structural integrity of mask 11 when secured to the face of wearer 12.

Visor 90 is preferably attached to filter body 14 at the opposite ends of top edge 24. Bonded areas 100 and 102 are preferably used to secure visor 90 to filter body 14. Various adhesives, ultrasonic seals and/or heat seals may be used to establish bonded areas 100 and 102. Ultrasonic seals (sometimes referred to as ultrasonic welding) have been found to be particularly advantageous for attaching visor 90 to radii portions R1 of mask 11.

Bonded areas 100 and 102 cooperate with their respective radii portions R1 to allow visor 90 to easily adapt to the contours of the face of wearer 12. Notch 98 in lower edge 96 along with bonded areas 100 and 102 prevent visor 90 from moving up with respect to mask 11 and forming a gap therebetween. Radii portions R1 allow positioning bonded areas 100 and 102 to adjust visor 90 and mask 11 for optimum fit with the face of wearer 12.

Blow-by associated with normal breathing of wearer 12 is substantially eliminated by properly selecting the dimension and location of malleable strip 26 with respect to top edge of 24. Malleable strip 26 is preferably positioned in the center of top edge 24 and has a length in the range of fifty percent to seventy percent of the total length, dimension A, of top edge 24. For one embodiment of the present invention, the performance of mask 11 was enhanced by using malleable strip 26 manufactured from quarter-tempered aluminum. For this embodiment, the length of malleable strip 26 was approximately 54 percent of the length of top edge 24 with a thickness of 0.021 inches and a width of 0.197 inches.

The present invention allows designing mask 11 with the optimum periphery to fit on the face of wearer 12, the optimum dimension for malleable strip 26 to form an enhanced fluid barrier with the nose and face of wearer 12, and the optimum position for visor 90 with respect to the eyes and uncovered portion of the face of wearer 12. The present invention allows modification to the length of top edge 24 and bottom edge 38 while maintaining approximately the same surface area for normal breathing through filter media 34.

Elastic straps or headbands 16 and 18 are preferably constructed from resilient polyurethane, but may be constructed from elastic rubber, or a covered stretch yarn. The covered stretch yarn may consist of an elastomeric material wrapped with nylon or a polyester. The use of two headbands 16 and 18 substantially improves the fluid barrier between the periphery of mask 11 and the face of wearer 12.

As illustrated in FIG. 3*a*, upper and lower portions 20 and 22 each include an outer mask layer 30 that is preferably constructed from a spun-bonded polypropylene. Outer mask layers 30 may also be constructed from a bi-component and/or powder bonded material such as polyethylene or polypropylene, a cellulastic tissue, or a spun-bonded polyester. Outer mask layers 30 typically have a basis weight range of 0.5 ounces per yard to 1.0 ounces per yard. 0.9 ounces per yard is one of the preferred basis weights for outer layers 30.

Inner mask layers 32 are preferably composed of a bicomponent polyethylene and polypropylene. Layers 32 may also be constructed from polyester and/or polyethylene material or cellulastic tissue. Layers 32 typically have a basis weight range of 0.4 ounce per yard to 0.75 ounces per yard. 0.413 ounces per yard is one of the preferred basis weights for layers 32. One or more intermediate layers of filter media may be disposed between outer mask layer 30 and inner mask layer 32. Selection of the number and type of intermediate layers of filter media will depend upon the intended use and function for mask 11.

In FIG. 3*a*, filter body 14 is shown with only one intermediate mask layer 34 which comprises the filter media for the associated mask 11. This layer is preferably constructed from a melt-blown polypropylene, but may be constructed from an extruded polycarbonate, a melt-blown polyester, or a melt-blown urethane.

Figure 3B:
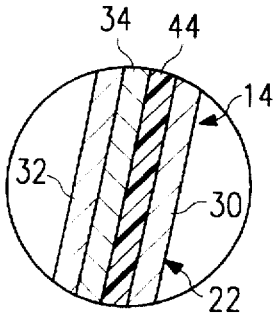
FIG. 3*b* is an enlarged sectional view with portions broken away of an alternative embodiment of the mask of FIG. 1 showing four layers of material including at least one liquid impervious layer.

FIG. 3*b* shows an alternative embodiment of the present invention in which filter body 14 includes two intermediate layers 34 and 44 of filter media. Layer 44 may be formed from a barrier material that is gas permeable and permits gas (air) to pass through filter body 14 in both directions and is impermeable to liquid passing through mask 11 in at least one direction. Layer 44 is preferably arranged to prevent the passage of liquids from the exterior of filter body 14 through layer 44 to the interior of filter body 14.

A more complete description of the construction and operation of such material can be found in U.S. Pat. No. 3,929,135 entitled Absorptive Structure Having Tapered Capillaries, issued on Dec. 30, 1975 to Hugh A. Thompson. Such materials are often constructed from a low density polyethylene and include small apertures which prevent liquids from passing therethrough due to the liquid's relatively high surface tension. U.S. Pat. Nos. '960; '533 and 5,150,703 entitled Liquid Shield Visor for a Surgical Mask with a Bottom Notch to Reduce Glare, issued on Sep. 29, 1992 to Hubbard, et al provide additional information on materials which may be used for layers 30, 32, 34 and 44 and face masks constructed with such materials. These patents which are assigned to Tecnol Medical Products, Inc. are incorporated by reference for all purposes within this application. Other types of microporous film may be satisfactorily used with the present invention.

The use of barrier materials such as layer 44 is particularly important when mask 11 with visor 90 is worn in an environment where the wearer may be exposed to "body fluids". These fluids such as blood, urine and saliva may contain highly contagious germs and viruses. Contact of AIDS-contaminated body fluids with another person's source of body fluids, such as the eyes, nose and mouth, may transmit the disease. Therefore, it is often preferable to include layer 44 which is resistant to the passage of liquids through filter body 14 to prevent body fluids from contacting the nose and mouth of the wearer.

Figure 3C:
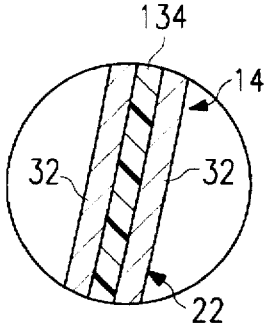
FIG. 3*c* is an enlarged sectional view with portions broken away of another alternative embodiment of the mask of FIG. 1 showing three layers of material including at least one layer of expanded PTFE filter media.

FIG. 3*c* shows another alternative embodiment of the present invention in which filter body 14 includes intermediate layer 134 of filter media disposed between layers 32. For this particular embodiment of the present invention the inner and outer mask layers 32 are formed from the same type of material. However, various types of material may be used with intermediate mask layer 134.

For one embodiment of the present invention intermediate mask layer 134 was formed from an expanded polytetrafluoroethylene (PTFE) membrane. Such materials are manufactured by W. L. Gore & Associates. A more complete description of the construction and operation of such materials can be found in U.S. Pat. No. 3,953,566 entitled Process for Producing Porous Products, issued on Apr. 27, 1976 to Robert W. Gore, and U.S. Pat. No. 4,187,390 entitled Porous Products and Process Therefor, issued on Feb. 5, 1980 to Robert W. Gore. These patents are incorporated by reference for all purposes within this application. For some applications and operating environments the use of filter media 134 substantially enhances the performance of the associated aerosol mask 11.

As demonstrated by the previous comments, the generally trapezoidal shape of filter body 14 including the preferred ratios for the dimensions of filter body 14 and radii R1 and R2 allows a wide variety of materials to be used in the manufacturer of the mask layers which comprise filter body 14. The present invention has significantly increased the types of material which may be satisfactorily used in constructing filter body 14. The present invention also allows more options with respect to selecting the number of layers of material used to manufacture filter body 14.

A mask with the filter media or intermediate layer 34 was selected to test filtration of particle sizes of about 1.0 micron. In tests run using standardized testing procedures for filter materials, filter media 34 had an efficiency in excess of 98 percent. The efficiency is defined by the equation:

$$\%Eff = \frac{Avgc - Avgt}{Avgc} \quad (1)$$

where:

c is the particle count with no test sample in the path and Avgc is the average particle count of three runs; and t is the particle count with a test sample in the path and Avgt is the average particle count of three runs.

In the test procedure, 1.0 micron latex particles were aerosolized, dried and passed through the test samples at the rate of one cubic foot per minute. The particles were counted using a laser based particle counter.

Top edge 24 of mask 11 may be faced with an edge binder 36 that extends across the open end of mask 11 and covers malleable strip 26. similarly, lower portion 22 of mask 11 forms a bottom edge 38 that is encompassed in an edge binder 40. Edge binders 36 and 40 are preferably constructed from a spun-laced polyester material. The binders may also be constructed from a number of thermally bonded bicomponent materials or from polypropylene or polyethylene non-porous plastic films.

Referring to FIG. 1, mask 11 is illustrated as being located on the face of wearer 12. Upper portion 20 with malleable member 26 located in top edge 24 and lower edge 96 of visor 90 conform very closely to the configuration of the nose and cheeks of wearer 12. It is also important that the fit between bottom edge 38 and the chin of wearer 12 and top edge 24 and the nose and cheeks of the wearer 12 fit very closely since any leaks result in bypass or blow-by of air either entering mask 11 or being discharged from mask 11 as it is used by wearer 12. Also, leakage around top edge 24 may cause fogging of visor 90.

Accordingly, elastomeric headbands or straps 16 and 18 have their ends attached at the junctures between top edge 24 and bottom edge 38 of mask 11 as shown in FIG. 3*a*. The arrangement is such that strap 16 can be placed over the top of the head of wearer 12, as illustrated in FIG. 1, in alignment with bottom edge 38 of mask 11 so that a direct force is exerted along that line urging bottom edge 38 into sealing engagement with the chin of wearer 12. Similarly, strap 18 is positioned around the lower base of the skull and in direct alignment with top edge 24 of mask 11 and thus placing a force thereon which tends to move top edge 24 into tighter sealing engagement with the nose and cheeks of wearer 12. As shown in FIG. 3*a*, the ends of straps 16 and 18 are secured at the same location between top edge 24 and bottom edge 38 with no gap between the ends of straps 16 and 18. The position of attaching straps 16 and 18 to filter body 14 in cooperation with radii R1 and R2 results in the optimum pull angle to form a fluid tight barrier between the interior of mask 11 and the face of wearer 12.

It is extremely difficult to construct a mask that will fit the facial configuration of all wearers without constructing the mask specifically for each individual face. Los Alamos National Laboratory has established standards for the testing of face masks that utilize panels of people with different face sizes and configurations. Such facial features represent approximately 95 percent of the working population. Two different panels of people are utilized: one, according to face width and length and the other according to lip length and face length. Twenty-five panelists are utilized in each category.

During a typical test, each panelist dons a mask and a hood is placed over their head with saccharin introduced into the hood. The panelist is then asked to perform a certain routine of exercises. If the panelist tastes the saccharin, the mask fit test is a failure. Mask 11 was subjected to such testing and tested successfully on almost 90 percent of the panelists. Such results are substantially better than any of the current existing masks.

In addition to having a tight peripheral seal, it is essential that mask 11 have good breathability characteristics. That is, mask 11 should require a low differential in pressure to permit air to flow easily through filter body 14 despite the fact that mask 11 will filter 1 micron and smaller particles and have a very tight fit between edges 24 and 38 and the face of wearer 12. A low differential pressure for air flow indicates good breathability through a face mask.

Upper portion 20 and lower portion 22 of mask 11 have a combined surface area through which air can flow of about 250 square centimeters. Thus, body 14 of mask 11 has a surface area of approximately 250 square centimeters which provides enhanced breathability for wearer 12. Tests were run utilizing a flow rate of thirty-two (32) liters per minute across the entire flow area. Approximately thirty masks incorporating the present invention were checked. The masks had a pressure differential ranging from 0.9 to 1.3 mm of water with a mean pressure differential across the mask of about 1.25 mm of water. Such a low differential in pressure across the mask provides excellent breathability characteristics despite the ability of the mask to filter one micron and smaller sized particles with essentially zero edge leakage around the periphery of mask 11.

Elastomeric head bands or straps 16 and 18 may be replaced by surgical tie straps if desired. Also, a veil guard or gap guard may be attached to bottom edge 38 to protect the neck of wearer 12 from undesirable contact with aerosols and body fluids. The use of a veil guard and surgical tie straps are more fully described in parent patent application Ser. No. 07/991,154 filed Dec. 16, 1992, entitled Disposable Aerosol Mask, now U.S. Patent No. 5,322,061.

Mask 11 may be assembled using the following process. Each layer 30, 32 and 34 is placed on its appropriate sheet of raw material. Inner mask layer 32 for upper portion 20 is placed in juxtaposition with inner mask layer 32 for lower portion 22. The inner mask layers 32 cooperate with each other to form the inside surface of the respective mask 11. First and second intermediate layers 34 are then placed in juxtaposition with respect to the respective first and second inner mask layers 32. First and second intermediate layers 44 may be included as desired. First outer mask layer 30 for upper portion 20 along with malleable strip 26 is then attached to the respective intermediate layers 34 and/or 44 along with the first inner layer 32 to form top portion 20. Second outer layer 30 is then attached to the respective intermediate layers 34 and/or 44 along with the second inner layer 32 to form bottom portion 22.

Binders 36 and 40 are preferably secured to top edge 24 and bottom edge 38 respectively by a plurality of ultrasonic seals 42. The three sides of upper portion 20 and lower portion 22 are connected with each other by heat sealing or ultrasonic bonding to form filter body 14 having a general trapezoidal shape with an open side defined by top edge 24 and bottom edge 38. Straps 16 and 18 are attached to the corners of top edge 24 and bottom edge 38 at the junction with upper portion 20 and lower portion 22 during ultrasonic bonding of the three sides of filter body 14. Darkened strip 28 is next attached by heat sealing or ultrasonic bonding to top edge 34 and radii portions R1. The remaining edge of darkened strip 28 is not attached to upper portion 20 to avoid limiting the breathability of filter body 14. Finally, visor 90 is attached to upper portion 20 at bonded areas 100 and 102.

Figure 4:
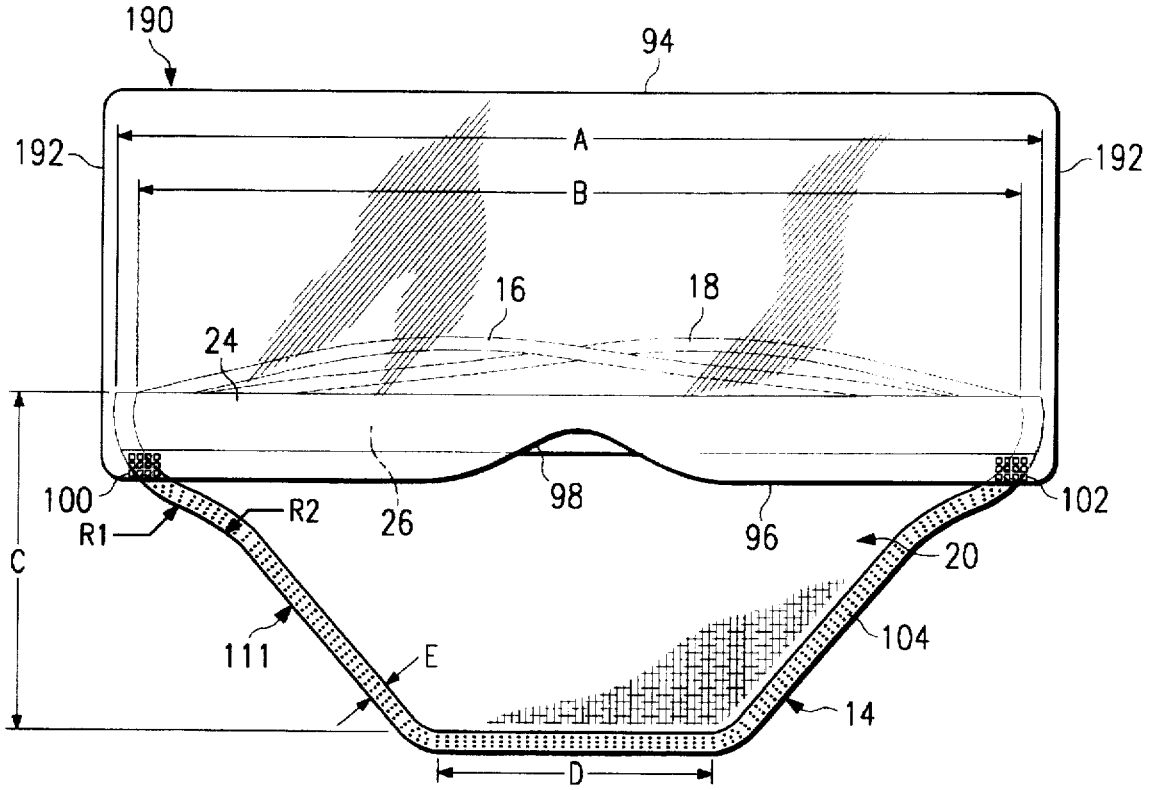
FIG. 4 is a plan view of an aerosol mask with an optically clear visor attached in accordance with an alternative embodiment of the present invention.

Another alternative embodiment of the present invention is represented by mask 111 with attached visor 190 as shown in FIG. 4. Mask 111 includes filter body 14 which may be secured to wearer 12 by securing members 16 and 18 as previously described for mask 11. As shown in FIG. 4, mask 111 does not include darkened strip of material 28. If desired, darkened strip 28 may be included with mask 111 in the same manner as previously described for mask 11.

Face shield or visor 190 is preferably the same as face shield or visor 90 with the exception of foam strip 92. By attaching visor 190 to filter body 14 as shown in FIG. 4, foam strip 92 is no longer required to prevent visor 190 from directly contacting the forehead of wearer 12. By selecting the proper location for bonds 100 and 102, visor 190 will stand away from the face of a person wearing mask 111.

For one embodiment of the present invention narrow sides 192 of visor 190 are preferably positioned perpendicular to top edge 24 of filter body 14. Lower edge 96 of visor 190 is preferably positioned between ½ inch and 1 inch below the top edge of malleable strip 26. Bonded areas 100 and 102 should extend in from the edge of filter body 14 at least ⅜ of an inch but no more than ⅛ of an inch past bonded border 104 (dimension E).

Although the present invention has been described in detail, it should be understood that various changes, substitutions and alternations can be made herein without departing from the spirit and the scope of the invention as defined in the following claims.

What is claimed is:

1. A disposable mask comprising:

a filter body having an opening sized to cover the nose and mouth of a wearer, said body having top and bottom edges with said top edge arranged to extend across the nose of said wearer and said bottom edge arranged to extend under the chin of said wearer;

said top edge having a respective first end and a respective second end opposite from each other and said bottom edge having a respective first end and a respective second end opposite from each other;

first securing means attached to said body adjacent to each end of said top edge and arranged to extend generally about the back of the head of said wearer in an approximate linear continuation from said top edge, said first securing means urging said top edge into tight engagement with said wearer to prevent fluid flow between said top edge and said wearer;

second securing means attached to said body adjacent to each end of said bottom edge and arranged to extend generally over the top of the head of said wearer in an approximate linear continuation from said bottom edge, said second securing means urging said bottom edge into tight engagement with said wearer to prevent fluid flow between said bottom edge and said wearer;

said first securing means and said second securing means, each having a respective first end and a respective second end;

said respective first ends of said first securing means and said second securing means disposed between said respective first ends of said top edge and said bottom edge;

said respective second ends of said first securing means and said second securing means disposed between said respective second ends of said top edge and said bottom edge; and a visor dimensioned to cover the eyes of said wearer and attached to said filter body proximate said opposite ends of said top edge.

2. The mask of claim 1 wherein said filter body further comprises:

an upper portion of generally trapezoidal configuration having a longer side forming said top edge;

a lower portion of generally trapezoidal configuration having a longer side forming said bottom edge; and said upper and lower portions being joined along all remaining sides.

3. The mask of claim 2 wherein said filter body further comprises:

first radii portions formed on opposite sides of said filter body adjacent to said top edge and said bottom edge; and said visor bonded with said first radii portions on opposite sides of said filter body.

4. The mask of claim 1 wherein said filter body further comprises:

a plurality of bonds between said visor and said filter body; and said bonds positioned on said filter body to provide optimum fit between said mask, said visor and said wearer's face.

5. The mask of claim 1 further comprising:

an elongated malleable member located in said top edge for conforming said top edge to the contours of said wearer's nose and cheeks; and said malleable member located proximate the center of said top edge and having a length corresponding to more than 50% and less than 70% of the length of said top edge.

6. The mask of claim 1 further comprising a strip of darkened material on the exterior of said filter body adjacent to said visor.

7. The mask of claim 1 wherein said filter body further comprises an intermediate layer of material which is gas permeable in both directions through said filter body and liquid impermeable in the direction from outside said filter body to inside said filter body.

8. The mask of claim 1 wherein said filter body further comprises:

an intermediate layer of filter media formed from expanded polytetrafluoroethylene (PTFE); and a first layer of bicomponent material disposed on one side of said intermediate layer of expanded polytetrafluroethylene and a second layer of the same bicomponent material disposed on the opposite side of said layer of expanded polytetrafluoroethylene.

9. A disposable face mask comprising:

a filter body having an opening sized to cover the nose and mouth of a wearer, said filter body having top and bottom edges with said top edge arranged to extend across the nose and cheeks of said wearer and said bottom edge arranged to extend under the chin of said wearer;

said top edge having ends opposite from each other and said bottom edge having ends opposite from each other, said ends of said top edge being joined with said ends of said bottom edge to define in part said opening in said filter body;

said filter body comprising an upper portion of trapezoidal configuration having a longer side forming said top edge and a lower portion of trapezoidal configuration having a longer side forming said bottom edge;

a plurality of radii formed on opposite sides of said filter body extending from said top edge and said bottom edge; and a visor dimensioned to cover the eyes of said wearer and attached to said radii of said filter body proximate said opposite ends of said top edge.

10. The mask of claim 9 wherein said filter body further comprises:

first securing means attached to said filter body adjacent to each end of said top edge and positioned to extend generally about the back of said head of said wearer in an approximate linear continuation of said top edge, said first securing means for urging said top edge into tight engagement with said wearer for preventing fluid flow between said top edge and said wearer; and second securing means attached to said filter body adjacent to each end of said top edge and positioned to extend generally over the top of said head of said wearer in an approximate linear continuation of said bottom edge, said second securing means for urging said bottom edge into tight engagement with said wearer for preventing fluid flow between said bottom edge and said wearer.

11. The mask of claim 9 further comprising an elongated malleable member located in said top edge for conforming said top edge to the contours of said wearer's nose and cheeks.

12. The mask of claim 9 wherein said plurality of radii further comprises:

first portions with a first radius that curves inward towards said top edge;

second portions with a second radius that curves outward from said first portion of said filter body; and a plurality of bonds between said visor and said first portions having said first radius.

13. The mask of claim 12 wherein said filter body further comprises said second radius tangent to said first radius.

14. The mask of claim 9 wherein said filter body comprises a layer of filter media for restricting the flow of liquids through said filter body.

15. The mask of claim 9 wherein said filter body further comprises an intermediate layer of filter media formed from expanded polytetrafluoroethylene (PTFE).

16. The mask of claim 15 wherein said filter body further comprises a first layer of bicomponent material disposed on one side of said intermediate layer of expanded polytetrafluoroethylene and a second layer of the same bicomponent material disposed on the opposite side of said layer of expanded polytetrafluoroethylene.

17. A method of making a disposable aerosol mask having a plurality of layers of selected materials, the method comprising the steps of:

placing first and second inner mask layers having a generally trapezoidal shape in juxtaposition for forming an inside surface of the mask;

placing at least first and second intermediate mask layers of polytetrafluoroethylene material having a generally trapezoidal shape in juxtaposition to said respective first and second inner mask layers;

placing a first outer mask layer of generally trapezoidal shape in juxtaposition with said first intermediate mask layer for forming an upper portion of said mask;

placing a second outer mask layer of generally trapezoidal shape in juxtaposition with said second intermediate mask layer for forming a lower portion of said mask;

connecting said upper and lower portions along three sides of said generally trapezoidal shape to form a filter body with an open side and three closed sides extending therefrom;

connecting said first outer mask layer, said first intermediate mask layer and first inner mask layer to form a top edge having opposite ends along said open side;

connecting said second outer mask layer, said second intermediate mask layer and said second inner mask layer to form a bottom edge having opposite ends along said open side;

joining said ends of said top edge with said ends of said bottom edge;

securing an elongated malleable member along said top edge; and attaching a first and a second securing means between said ends of said top edge and said bottom edge for holding said mask on a wearer.

18. The method of claim 17 further comprising the step of attaching a visor to said top edge for covering the eyes of said wearer.

19. The method of claim 17 further comprising the steps of:

forming a plurality of radii in the sides of said filter body adjacent to said top edge and said bottom edge; and attaching a visor to said top edge for covering the eyes of said wearer.

20. A method of making an aerosol mask having a plurality of layers of selected materials, the method comprising the steps of:

placing first and second inner mask layers having a generally trapezoidal shape in juxtaposition for forming the inside surface of the mask;

placing first and second intermediate mask layers of liquid impervious material having a generally trapezoidal shape in juxtaposition to said respective first and second inner mask layers;

placing a first outer mask layer of generally trapezoidal shape in juxtaposition with said first intermediate mask layer for forming an upper portion of said mask;

placing a second outer mask layer of generally trapezoidal shape in juxtaposition with said second intermediate mask layer for forming a lower portion of said mask;

connecting said upper and lower portions along three sides of said generally trapezoidal shape to form a filter body with an open side;

connecting said first outer mask layer, said first intermediate mask layer and first inner mask layer to form a top edge having opposite ends along said open side;

connecting said second outer mask layer, said second intermediate mask layer and said second inner mask layer to form a bottom edge having opposite ends along said open side;

joining said ends of said top edge with said ends of said bottom edge;

securing an elongated malleable member along said top edge; and attaching a first and a second securing means between said ends of said top edge and said bottom edge for holding said mask on a wearer.

21. The method of claim 20 further comprising the step of attaching a visor to said top edge for covering the eyes of said wearer.

22. The method of claim 20 further comprising the steps of:

forming a plurality of radii in the sides of said filter body adjacent to said top edge and said bottom edge; and attaching a visor to said top edge for covering the eyes of said wearer.

23. A disposable face mask comprising:

a filter body having an opening sized to cover the nose and mouth of a wearer, said filter body having top and bottom edges with said top edge arranged to extend across the nose and cheeks of said wearer, and said bottom edge arranged to extend under the chin of said wearer, an elongated malleable member located adjacent to said top edge for conforming said top edge to the contours of said wearer's nose and cheeks;

said body filter comprising an upper portion of generally trapezoidal configuration having a longer side forming said top edge and a lower portion of generally trapezoidal configuration having a longer side forming said bottom edge;

said longer side of said top edge and said longer side of said bottom edge having generally matching dimensions and defining in part said opening of said filter body;

said upper and lower portions of said filter body being joined by a bonded border with a width of approximately one fourth of an inch along all remaining sides extending from said opening; and said filter body having a shorter side opposite from said longer side and generally parallel with said longer side, and the length of said longer side approximately three times the length of said shorter side.

24. The mask of claim 13 wherein said filter body further comprises:

the dimensions of said upper portion corresponding to the dimensions of said lower portion; and the distance from said longer side to said shorter side approximately equal to the length of said shorter side.

* * * * *

UNITED STATES PATENT AND TRADEMARK OFFICE

CERTIFICATE OF CORRECTION

PATENT NO. : 5,765,556

DATED : June 16, 1998

INVENTOR(S) : Kevin K. Brunson

It is certified that error appears in the above-indentified patent and that said Letters Patent is hereby corrected as shown below:

Title page, page 2,under U.S. PATENT DOCUMENTS, please correct
4,419,994 12/1983 Hilston.....128/206.19 to read
4,419,994 12/1983 Hilton.....128/206.19

Title page, page 2, under U.S. PATENT DOCUMENTS, please insert
5,012,805 5/1991 Muckerheide.....128/205.28

Signed and Sealed this

Fifteenth Day of September, 1998

*Attest:*

*Attesting Officer*

Bruce Lehman

BRUCE LEHMAN

*Commissioner of Patents and Trademarks*